US005784970A

United States Patent [19]

Fehr et al.

[11] Patent Number: 5,784,970

[45] Date of Patent: Jul. 28, 1998

[54] CARRIAGE BODY FRAME

[75] Inventors: Peter Fehr, Schafhisheim; Lorenzo Kocher, Wohlen; Robert J. Dean, Uhwiesen; Roger Betschart, Weiningen; Lutz Kampmann, Beringen, all of Switzerland

[73] Assignee: Alusuisse Technology & Management Ltd., Switzerland

[21] Appl. No.: 780,511

[22] Filed: Jan. 8, 1997

[30] Foreign Application Priority Data

Jan. 24, 1996 [EP] European Pat. Off. ..... 96810048

[51] Int. Cl.[6] ..... B61D 17/04

[52] U.S. Cl. ..... 105/401; 105/409

[58] Field of Search ..... 105/396, 397, 105/401, 404, 409; 296/191, 193, 197; 244/131, 133

[56] References Cited

U.S. PATENT DOCUMENTS

| | | | |
|---|---|---|---|
| 4,031,677 | 6/1977 | Tantlinger | 52/262 |
| 5,032,443 | 7/1991 | Rietdijk et al. | 428/121 |
| 5,042,395 | 8/1991 | Wackerle et al. | 105/401 |
| 5,106,034 | 4/1992 | Yagla et al. | 244/3.24 |
| 5,140,913 | 8/1992 | Takeichi et al. | 105/397 |
| 5,433,151 | 7/1995 | Ohara et al. | 105/401 |
| 5,601,034 | 2/1997 | Tao et al. | 105/397 |

FOREIGN PATENT DOCUMENTS

| | | |
|---|---|---|
| 0672567 | 9/1995 | European Pat. Off. . |
| 8910779 | 12/1989 | Germany . |

*Primary Examiner*—S. Joseph Morano
*Attorney, Agent, or Firm*—Bachman & LaPointe, P.C.

[57] ABSTRACT

A carriage body frame with a passenger compartment having longitudinal load-bearing sections of aluminum and light-weight composite panels between the load-bearing sections is such that the composite panels feature a plastic core with aluminum outer sheets adhesively bonded to both sides. The outer sheets extend partially over an aluminum connecting section which is integral to the composite panel; and fit to this by virtue of shape. The connecting section exhibits connecting strips which rest on correspondingly arranged connecting strips on the load-bearing section. The connecting section is joined to the load-bearing section by of laser welding. The outer sheets are joined at a free edge, likewise by laser welding, to the connecting section and, in the region of at least one connecting strip, the connecting section exhibits a U-shaped longitudinal channel which acts as a trap for adhesive and over which an outer sheet passes.

11 Claims, 3 Drawing Sheets

CARRIAGE BODY FRAME

BACKGROUND OF THE INVENTION

The invention relates to a carriage body frame for high speed trains, in particular magnetically levitated trains, having a passenger compartment with longitudinal load-bearing sections of aluminum and light-weight composite panels inserted between the load-bearing sections.

A carriage body frame for high speed trains has to meet high demands regarding air-tightness and rigidity under conditions of compression, thermal and sound insulation, collision tolerance and weight, and high demands with respect to ease of manufacture and assembly. Carriage body frames of conventional design are not able to meet the set requirements in all respects.

A carriage body frame of the kind mentioned above, made known via EP-A-0622285, is such that the light-weight composite panels comprise a plastic core clad on both sides by an outer layer of plastic. The connection between the composite panels and the longitudinal load-bearing sections is made via an inter-mediate section of aluminum which is adhesively bonded between the outer layers of the composite section and is welded to the load-bearing section.

SUMMARY OF THE INVENTION

In view of the present state of the art the object of the present invention is to provide a carriage body frame of the kind described above which is characterized in particular by low weight, high rigidity and good long term strength properties.

That objective is achieved by way of the invention in that:

a) the composite panels feature a plastic core adhesively bonded to outer sheets of aluminum, b) the outer sheets extend partially over an aluminum connecting section which is integral to the composite panel, and fit to this by virtue of shape, c) the connecting section exhibits connecting strips which rest on correspondingly arranged connecting strips on the load-bearing section and d) the connecting section is joined to the load-bearing section by means of laser welding.

A particularly preferred version of the carriage body frame according to the invention is such that also the outer sheets are joined to the connecting section at a free edge by means of laser welding.

The parts to be joined by laser welding have to be kept absolutely free of adhesive; in the region of at least one connecting strip the connecting section may, therefore, exhibit a longitudinal channel which is U-shaped in cross-section and acts as a trap for adhesive, and is covered by the outer sheet. As a result of this special design of connecting section, the connecting strip projecting out from the connecting section has a certain amount of freedom of movement, as a consequence of which it is relatively easy to accommodate tolerances during assembly.

In the case of a particularly preferred composite panel the core is of foamed polyetherimide (PMI) and the outer sheets are of an AlMg alloy, especially an alloy of the AlMg3 type.

The connecting sections and/or the load-bearing sections may e.g. be of an extruded AlMgSi alloy.

The connecting section is preferably in the form of a hollow-die section.

BRIEF DESCRIPTION OF THE DRAWINGS

Further advantages, features and details of the invention are revealed in the following description of preferred exemplified embodiments and with the aid of the drawing showing schematically in FIG. 1 a cross-section through a carriage body frame.

DETAILED DESCRIPTION

Figure 1:
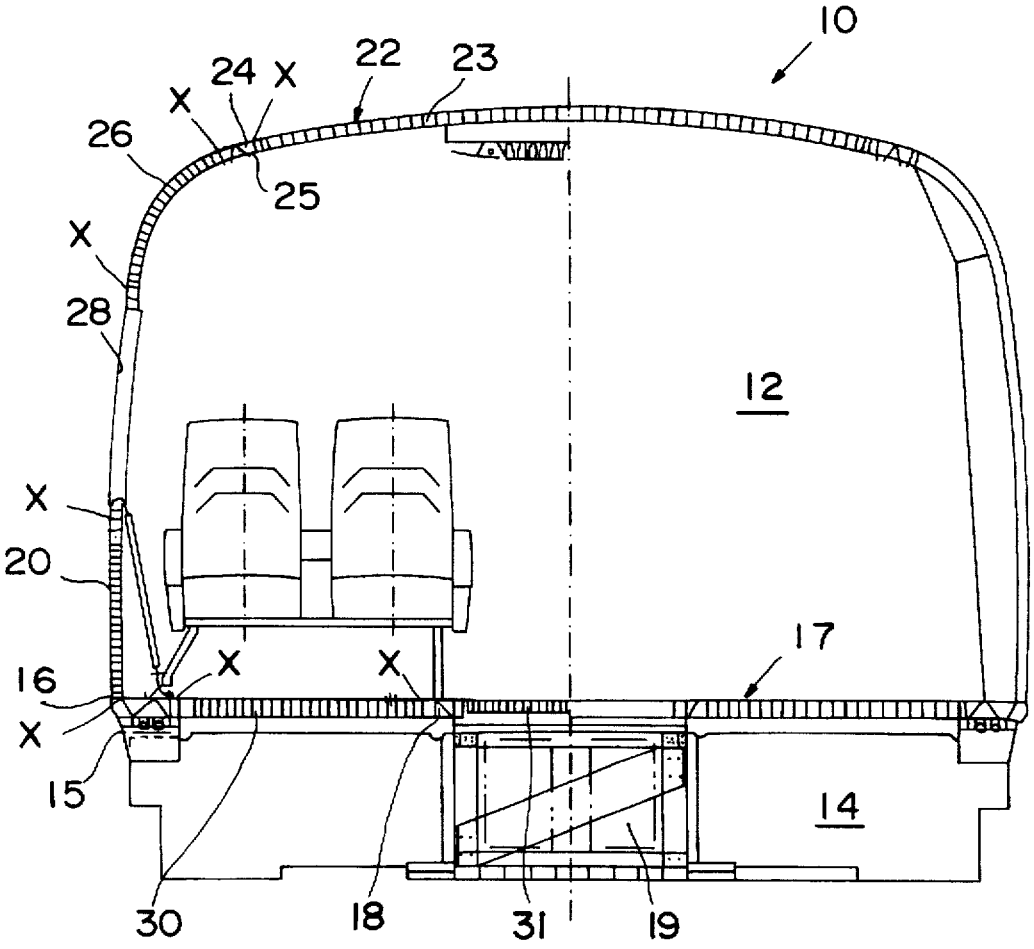

A carriage body frame 10 of a magnetically levitated train for passenger transport features, as shown in FIG. 1, a passenger space 12 and an under-floor structure 14 with lower struts 15 which are in two parts. The passenger space 12 and the under-floor structure 14 form two main units which are manufactured separately, completely fitted out independent of each other and finally assembled to give a finished carriage body frame. A light-weight aluminum structure combining extruded-section/sandwich-panel technology is employed for the passenger space 12.

The passenger space 12 exhibits a floor 17 delimited by two outer longitudinal sections 16. The floor 17 is formed by two outer floor panels mounted between the outer longitudinal sections 16 and inner longitudinal sections 18 and by an inner floor panel 31 mounted between the two inner longitudinal sections 18 above a central channel 19.

Side walls 20 project up from the outer longitudinal sections 16 and are connected to a roof 22 via window posts 28.

The roof 22 comprises a main roof part 23 situated between roof struts 24 and transition pieces 26 joining the roof struts to the window posts 28.

Figure 2:
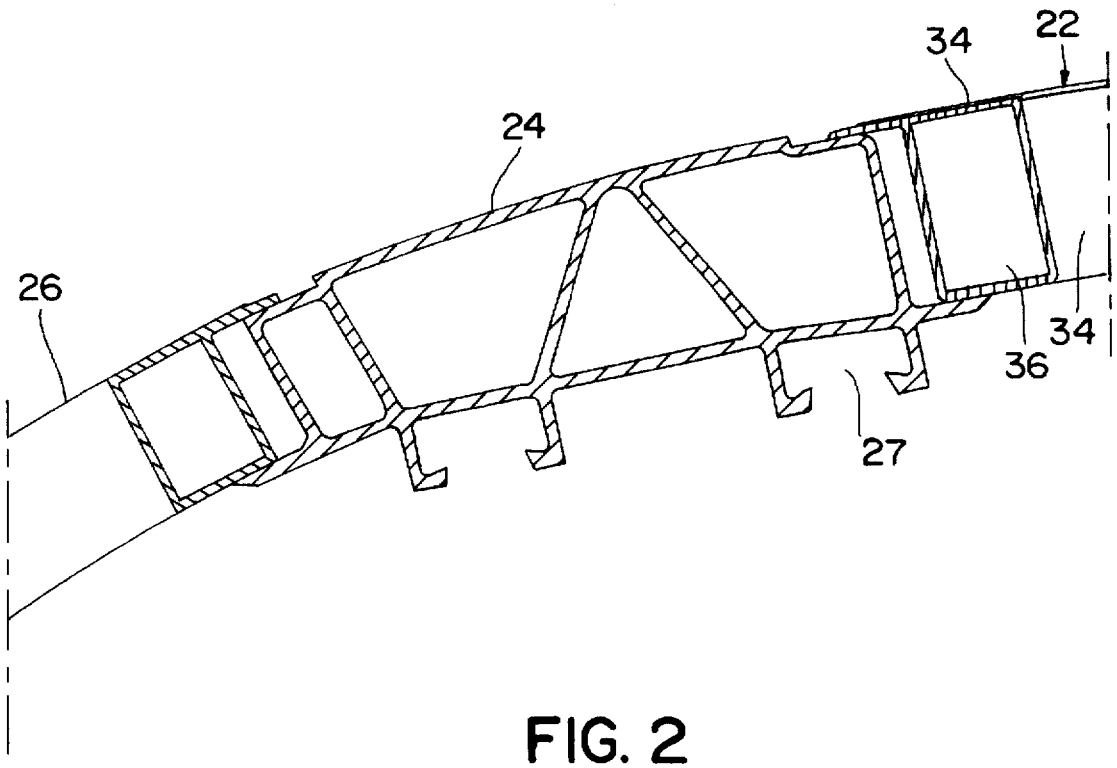
FIG. 2 an enlargement of part of FIG. 1.

FIG. 2 shows the connection between the main part 23 of the roof and the transition piece 26 joined to the roof strut 24. The roof strut 24 is in the form of an extruded hollow section made of an AlMgSi alloy. The main part 23 of the roof and the transition piece 26 are in the form of curved sandwich panels and feature a core 32 clad on both sides with outer sheets 34. The core is e.g. of foamed polyetherimide, the outer sheets of an alloy of the AlMg3 type. The connection between the main roof part 23 and the roof strut 24 and between the transition piece 26 and the roof strut 24 is made via a hollow connecting section 36 which is integrated in the main part 23 of the roof and the transition piece 26; section 36 is likewise an extruded section of the AlMgSi type. Integral undercut grooves 25 in the roof strut 24 facing the interior of the carriage provide bracing of the roof strut 24 during assembly of the body frame 10 and may also be employed for securing interior cladding.

Figure 3:
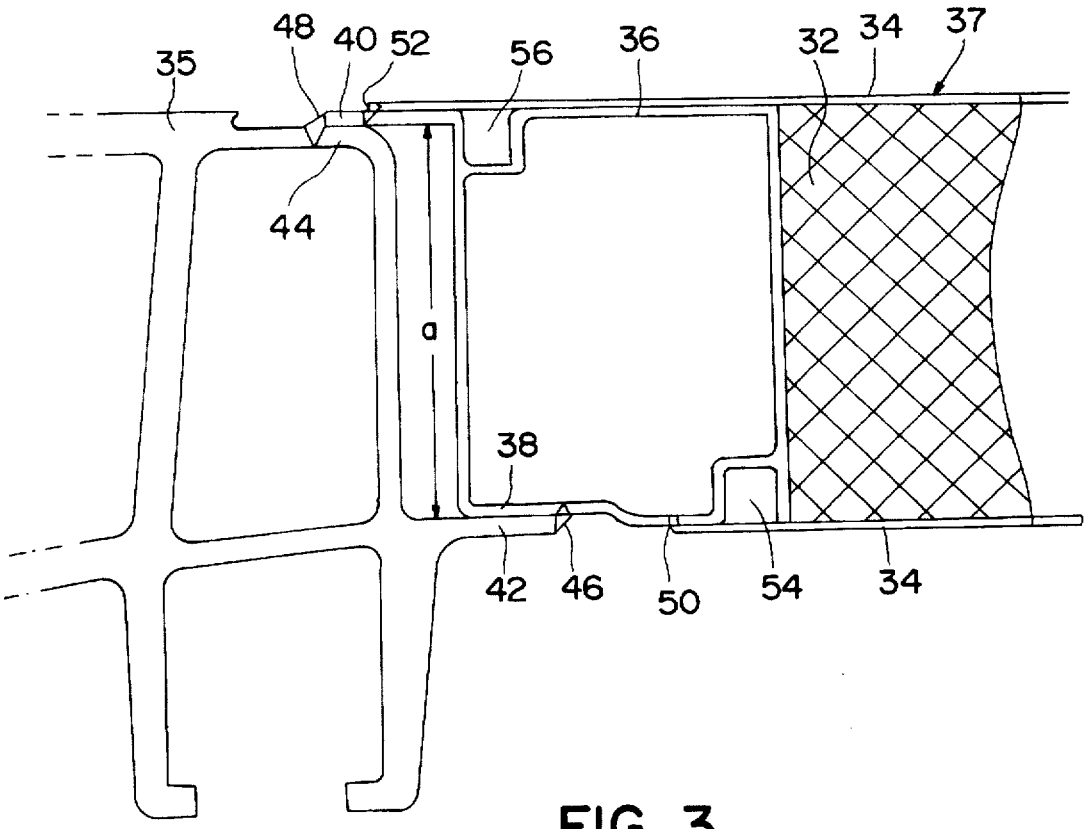
FIG. 3 a special version of a joint.

FIG. 3 shows in detail the connection between a load-bearing section 35 and a composite sandwich panel 37 the foamed core 32 of which is clad on both sides by outer sheets 34. The outer sheets 34 extend over the connecting section 36, which is aligned with the surfaces of the core 32 and fit to it by virtue of shape. The connection between the outer sheets 34 and the core 32 or the connecting section 36 is made via a layer of adhesive not shown in the drawing.

The connecting section 36 which is integrated in the composite panel 37 and is for making the connection to the load-bearing section features an integral first contact strip 38 and a second contact strip 40 projecting out from the connecting section 36. These two contact strips 38, 40 of the connecting section 36 run parallel to each other a distance a apart which corresponds to the distance separating two contact strips 42, 44 on the load-bearing section 35. The ends of the contact strips 42, 44 are joined to the corresponding contact strips 38, 42 via welded joints 46, 48 made by laser welding.

The outer sheets 34 partially overlap the connecting section 36 and are joined at their free edges by laser welded joints 50, 52 to the underlying connecting section 36.

During laser welding, it is essential to prevent plastic entering the weld zone. For that reason, special precautions must be taken in the region of the weld between the outer sheets 34 and the underlying connecting section 36. This includes absolute freedom of adhesive near the edges of the sheets 34, whereby additional precautions may be taken by designing the connecting section 36 in a special manner in the region of the welds 50, 52. To that end, longitudinal channels 54, 56, so called adhesive traps, which are U-shaped in cross-section are provided in the connecting section 36. These cause the adhesive that is expressed under pressure when the outer sheets 34 are bonded to the core 32 to be captured in the channels 54, 56 and therefore not in the region where the weld seams 50, 52 are to be formed. The weld seams result in a gas-tight connection between the outer sheets 34 and the underlying connecting section 36; consequently, the possibility of loss of bond strength between the outer sheets 34 and the core can be ruled out, even after many years of service.

The longitudinal, U-shaped channel 56 neighboring the contact strips 52 to the load-bearing section 35 serves to accommodate tolerances in that the projecting strip 40 exhibits greater freedom of movement and so when the tolerance is too large can be pressed lightly against the contact surface 44 of the section 35 or, when the tolerance is small, can be slightly forced open.

The method of joining shown in detail especially in FIG. 3 can be used at all places in the body frame 10 where a sandwich panel has to be joined to a longitudinal section. In the version of body frame 10 shown in FIG. 1 the places where the method of joining shown in FIG. 3 are used are indicated by an x. The other joints between the transition piece 26 and the window posts 28, between the window posts 28 and the side wall 20 and between the inner longitudinal section 18 and the inner floor panel 31 are made by riveting.

The methods of joining sandwich panels 37 to load-bearing sections 35 described here enable the carriage body frame 10 in FIG. 1 to be pre-fabricated in a simple manner then assembled into the finished item by installing the window sections 28 and the inner floor panel 31. Of course the method of joining described for the cross-section of a carriage body frame 10 is also valid for the corresponding connections in the longitudinal direction of the carriage between the sandwich panels and intermediate transverse sections.

We claim:

1. Carriage body frame for high speed trains, which comprises: a passenger compartment; longitudinal load-bearing sections of said passenger compartment of aluminum and light-weight composite panels inserted between the load-bearing sections; wherein, a) the composite panels feature a plastic core adhesively bonded to outer sheets of aluminum, b) the outer sheets extend partially over an aluminum connecting section which is integral to the composite panel, and fit to the said connecting section by virtue of shape, c) the connecting section exhibits connecting strips which directly rest on correspondingly arranged connecting strips on said load-bearing section, and d) the connecting section is joined to said load-bearing section by means of laser welding, wherein the connecting strips of the connecting section run parallel to each other and are spaced a distance apart, and wherein the connecting strips of the load-bearing section run parallel to each other and are spaced a distance apart.

2. Carriage body frame according to claim 1, wherein the outer sheets are joined at a free edge by laser welding to the connecting section.

3. Carriage body frame according to claim 1, wherein the plastic core is of foamed polyetherimide.

4. Carriage body frame according to claim 1, wherein the outer sheets are made of an AlMg alloy.

5. Carriage body frame according to claim 4, wherein said alloy is of the AlMg3 type.

6. Carriage body frame according to claim 1, wherein at least one of the connecting sections and the load-bearing sections are of an extruded AlMgSi alloy.

7. Carriage body frame according to claim 1, wherein the connecting section is a hollow die section.

8. Carriage body frame according to claim 1, for magnetically levitated trains.

9. Carriage body frame according to claim 1, wherein the distance separating the connecting strips of the connecting section corresponds to the distance separating the connecting strips of the load-bearing section.

10. Carriage body frame according to claim 1, wherein at least one of the connecting strips of the connecting section extends outwardly from the connecting section, and wherein at least one of the connecting strips of the load-bearing section extends outwardly from the load-bearing section.

11. Carriage body frame for high speed trains, which comprises: a passenger compartment; longitudinal load-bearing sections of said passenger compartment of aluminum and light-weight composite panels inserted between the load-bearing sections; wherein, a) the composite panels feature a plastic core adhesively bonded to outer sheets of aluminum, b) the outer sheets extend partially over an aluminum connecting section which is integral to the composite panel, and fit to the said connecting section by virtue of shape, c) the connecting section exhibits connecting strips which rest on correspondingly arranged connecting strips on said load-bearing section, and d) the connecting section is joined to said load-bearing section by means of laser welding, and wherein in the region of at least one connecting strip the connecting section exhibits a U-shaped longitudinal channel which acts as a trap for adhesive and over which an outer sheet passes.

* * * * *